United States Patent [19]

Nagashino

[11] Patent Number: 4,548,539

[45] Date of Patent: Oct. 22, 1985

[54] METHOD AND APPARATUS FOR UNPACKING A BOX PACKED WITH COMPRESSED MATERIAL

[75] Inventor: Ayaji Nagashino, Hiratsuka, Japan

[73] Assignee: The Japan Tobacco & Salt Public Corporation, Tokyo, Japan

[21] Appl. No.: 564,528

[22] Filed: Dec. 22, 1983

[30] Foreign Application Priority Data

| | | | |
|---|---|---|---|
| Dec. 23, 1982 | [JP] | Japan | 57-224971 |
| Dec. 23, 1982 | [JP] | Japan | 57-224972 |
| Dec. 23, 1982 | [JP] | Japan | 57-224974 |
| Aug. 9, 1983 | [JP] | Japan | 58-144430 |
| Aug. 9, 1983 | [JP] | Japan | 58-144431 |

[51] Int. Cl.[4] ..... B65G 65/30; B65G 65/34

[52] U.S. Cl. ..... 414/412; 53/381 R; 414/403; 414/786

[58] Field of Search ..... 414/403, 411, 412, 422, 414/786; 222/162; 53/381 R, 536

[56] References Cited

U.S. PATENT DOCUMENTS

| | | | |
|---|---|---|---|
| 2,825,193 | 3/1968 | Loveridge | 53/536 |
| 2,836,946 | 6/1958 | Schroeder | 53/536 X |
| 2,925,185 | 2/1960 | Candido, Jr. | 414/411 |
| 2,997,833 | 8/1961 | Nigrelli et al. | 414/411 X |
| 3,179,268 | 4/1965 | Hatch | 414/403 |
| 3,729,108 | 4/1973 | Rice | 53/381 R |
| 3,853,235 | 12/1974 | Lambert et al. | 414/412 |

*Primary Examiner*—Robert J. Spar
*Assistant Examiner*—Stuart J. Millman
*Attorney, Agent, or Firm*—Armstrong, Nikaido, Marmelstein & Kubovcik

[57] ABSTRACT

A method and apparatus for unpacking a box packed with compressed material. The method comprises the steps of placing a box packed with compressed material and having flaps at a bottom thereof on a bed having an opening therein, lifting said box from said bed to allow said compressed material to start descending from within the box thereby causing said flaps to open gradually, raising a support member from said opening through said opened flaps to support said compressed material from below, continuing said lifting of the box until the flaps completely open, and lowering said support member to place said compressed material on said bed. The apparatus comprises an unpacking section having a bed, feed-in conveyor means to feed a box packed with compressed material and having flaps at a bottom thereof to said unpacking section, lift means provided above said unpacking section for lifting said box to allow said compressed material to start descending from within, and feed-out conveyor means to receive said emptied box from the unpacking section and feed out said emptied box from the apparatus.

11 Claims, 27 Drawing Figures a
b
c
d
e
D
1
1a
2
3
B
B1

METHOD AND APPARATUS FOR UNPACKING A BOX PACKED WITH COMPRESSED MATERIAL

BACKGROUND OF THE INVENTION

This invention relates to a method and apparatus for unpacking a box packed with compressed material and having flaps.

Tobacco leaves are mostly packed in casks, but recently, boxes made of thick paper such as cardboard have been adopted for packing purposes to reduce the transportation and packing costs. The tobacco leaves packed in a box weighs as much as 20 kg, so that its manual unpacking is not so easy.

SUMMARY OF THE INVENTION

It is therefore an object of the present invention to provide a method and apparatus for unpacking a box packed with compressed material quickly and easily to take out the same without causing deformation.

There is essentially provided, in one aspect, a method of unpacking a box packed with compressed material comprising the steps of placing a box packed with compressed material and having flaps at a bottom thereof on a bed having an opening therein; lifting said box from said bed to allow said compressed material to start descending from within the box thereby causing said flaps to open gradually; raising a support member from said opening through said opened flaps to support said compressed material from below; continuing said lifting of the box until the flaps completely open; and lowering said support member to place said compressed material on said bed.

In another aspect, there is essentially provided an apparatus for unpacking a box packed with compressed material comprising an unpacking section having a bed with an opening therein, and a support member adapted to be raised and lowered through said opening; feed-in conveyor means to feed a box packed with compressed material and having flaps at a bottom thereof to said unpacking section; lift means provided above said unpacking section for lifting said box therefrom to allow said compressed material to start descending from within thereby causing said flaps to open gradually, said support member being raised to support said compressed material through said opened flaps and lowered when the flaps are completely opened to place said compressed material on said bed; and feed-out conveyor means to receive said emptied box from said unpacking section and feed out said emptied box from the apparatus.

DETAILED DESCRIPTION OF THE EMBODIMENT

Figure 1:
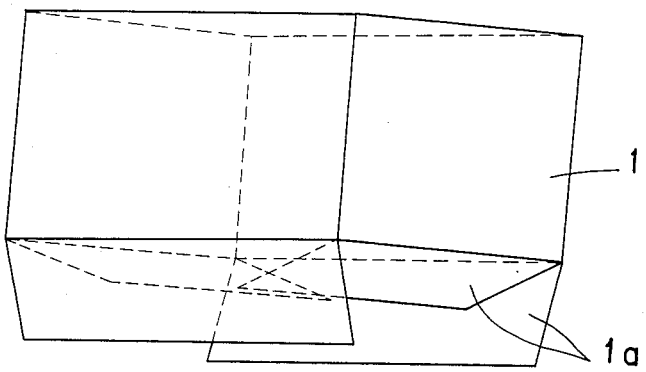
FIG. 1 is a perspective view showing a box packed with a compressed material.
Figure 2:
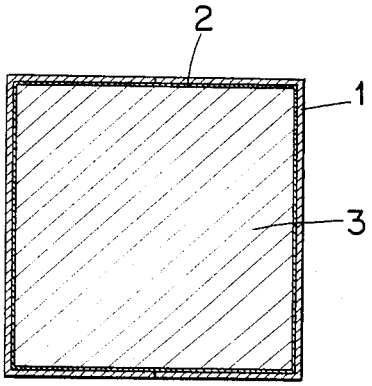
FIG. 2 is a sectional view of the box of FIG. 1.
Figure 3:
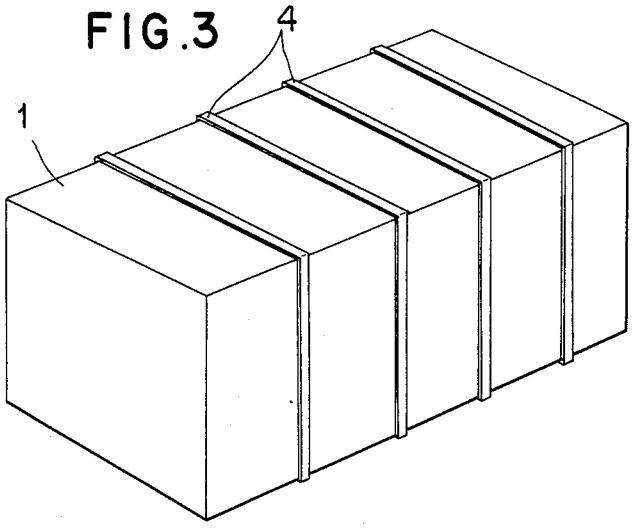
FIG. 3 is a perspective view of the box around which bands are secured.

FIG. 1 shows a box in which compressed tobacco material is packed. The box 1 is made of thick paper material and has a rectangular shape with flaps 1*a* bent from the four sides of the top and bottom thereof. Compressed tobacco material 3 is wrapped in moisture-proof paper sheets 2 and is packed in the box 1 (FIG. 2). Four flap securement bands 4 are wound around the box 1 as shown in FIG. 3.

Figure 5:
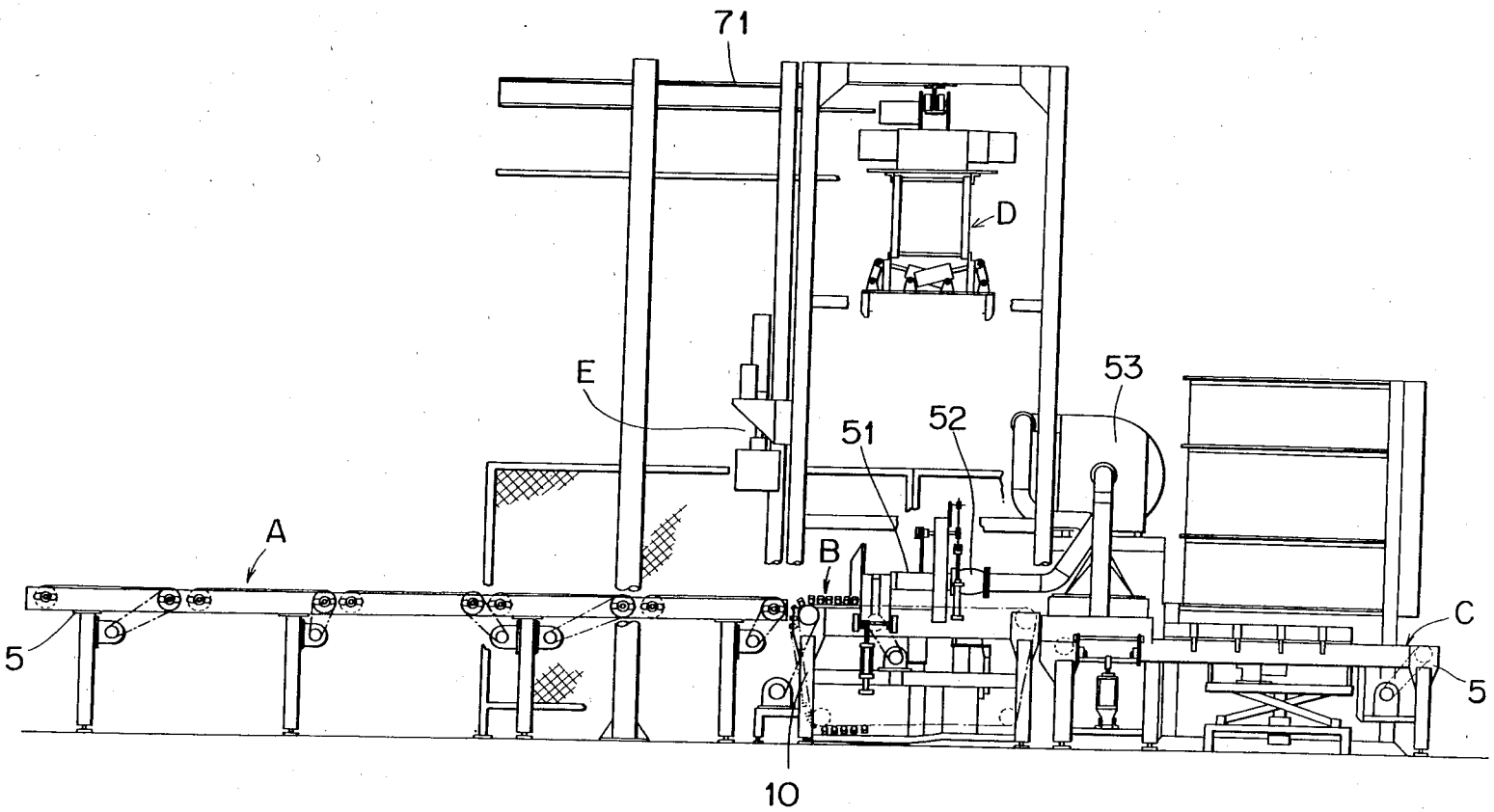
FIG. 5 is a sectional view showing an unpacking apparatus according to the invention.

Referring to FIG. 5, the apparatus according to the invention comprises a feed-in conveyor A, an unpacking section B disposed downstream of the feed-in conveyor A, a feed-out conveyor C disposed further downstream of the packing section B, a lifter D attached to a frame provided above the unpacking section B, and a drill E also attached to said frame.

Figures 4A, 4B, 4C, 4D, 4E:
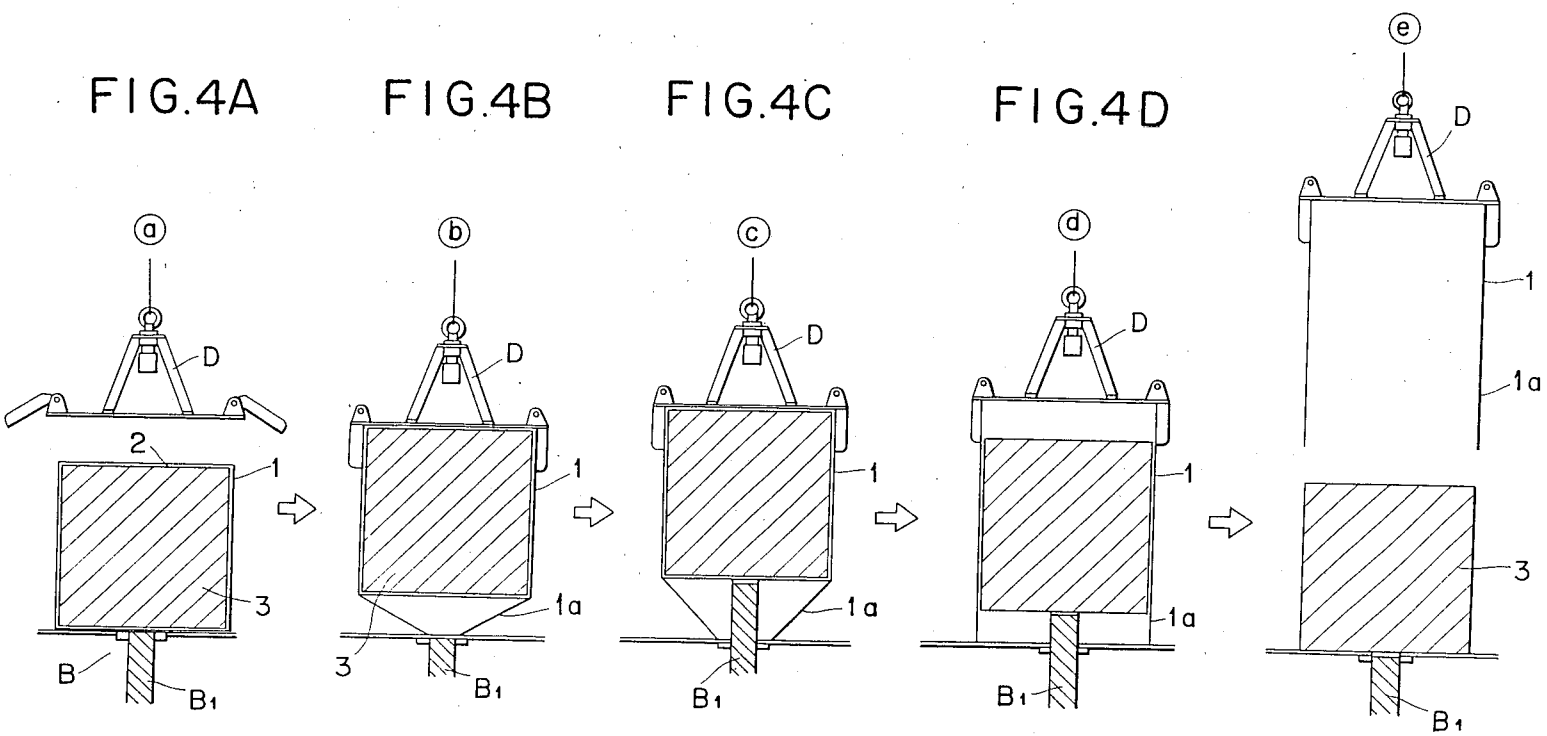
FIGS. 4*a* to 4*e* are views illustrating the method of unpacking according to the invention.

The unpacking is done in a manner as substantially shown in FIG. 4. The box 1 containing compressed tobacco material with flap securement bands removed in advance fed by the feed-in conveyor A to be transported onto the packing section B with one of the flap sides facing downward. Alternatively, said box 1 is placed with the flap securement bands wound therearound on the unpacking section B with said one flap side facing downward, and then the bands are cut by using a band cutter (FIG. 4*a*). Then, the box 1 containing the compressed tobacco material with the bands removed or cut is grasped and gradually lifted by the lifter D. As the box 1 is lifted, the flaps 1*a* are gradually opened because the compressed tobacco material contained in the box starts to descend (FIG. 4*b*). In this state, a vertically movable support member B1 provided in the unpacking section B is raised to enter the box 1 through an opening formed by the opened flaps 1*a*, so that it supports the center of the underside of the material 3 (FIG. 4*c*). In this state, the lifter D is raised continually, while the support member B1 is lowered (FIG. 4*d*). The compressed tobacco material 3 is thus eventually separated from the box 1 and placed on the unpacking section B (FIG. 4*e*). The empty box 1 lifted by the lifter D is moved sidewise and removed by the lifter D.

The compressed tobacco material packing box 1 has the bottom surface area of 770 mm by 1,100 mm, and the height of 720 mm. The effective support area of the support member B1 supporting the central portion of the underside of the compressed tobacco material 3 is at least 78 $cm^2$, and preferably 400 $cm^2$. The compressed tobacco material box 1 is lifted by approximately 0.3 m, when the support member B1 with the maximum support area as noted above can be inserted through the opening defined by the flaps 1*a*, and it is raised by approximately 0.4 m until the flaps 1*a* are completely opened so that the compressed tobacco material 3 can descend out of the box.

The moisture-proof paper sheets 2 provided inside the compressed tobacco material may be taken out together with the compressed tobacco material 3 onto the packing section B and manually removed. Alternatively, it may be removed together with the empty box 1 by causing a lift pawl of the lifter D to pierce the box.

The feed-in conveyor A and feed-out conveyor C are driven by chain-sprocket mechanism 6 provided in association with respective supports 5.

Figure 7:
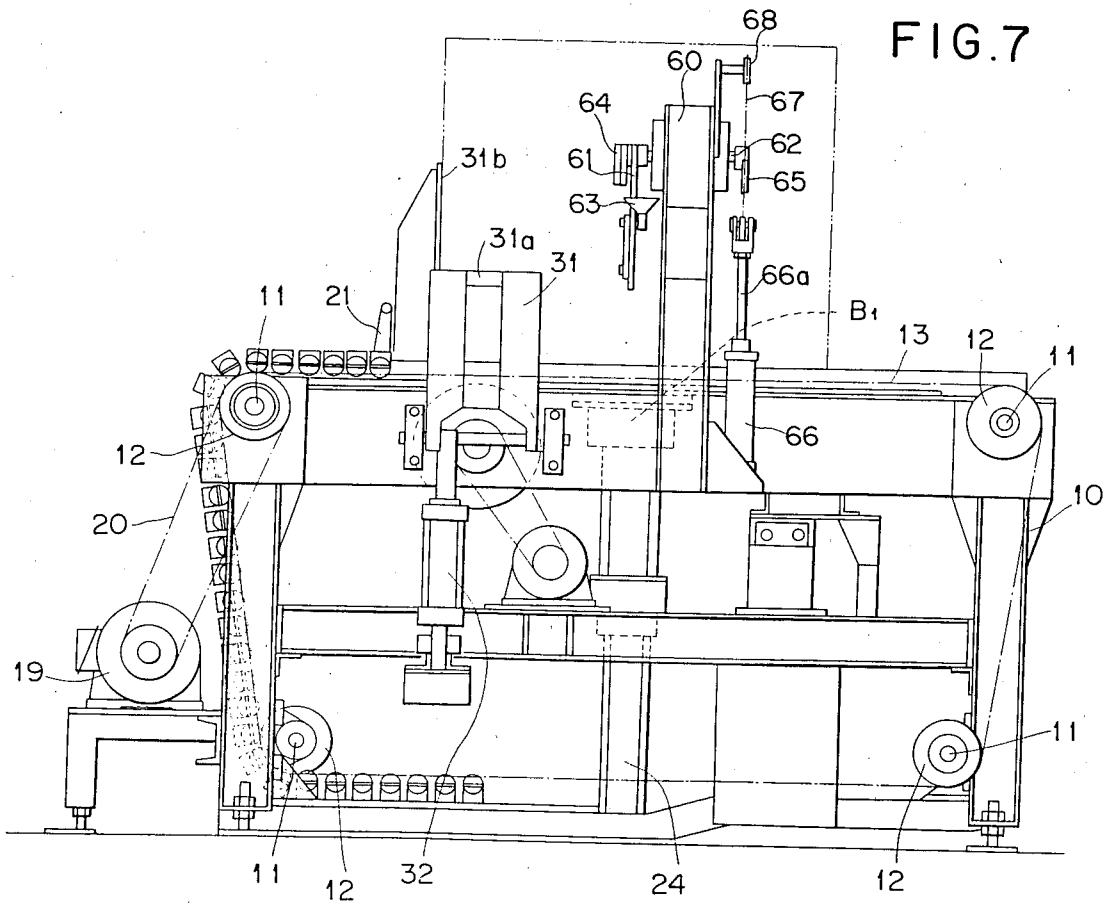
FIG. 7 is a side view showing an unpacking section.
Figure 10:
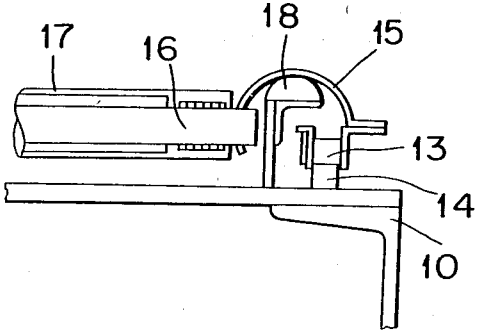
FIG. 10 is a sectional view showing an essential part of a carriage roller support mechanism.

Referring to FIG. 7, in the unpacking section B, support shafts 11 are provided in the upper and lower portions of respective front and rear supports 10. Each support shaft 11 has sprocket wheels 12 provided on the opposite ends. On the opposite sides of the supports 10, two parallel endless chains 13 are passed around said sprocket wheels 12. First parallel rails 14 are provided at the opposite lateral ends of the supports 10 as shown in FIG. 10. The two chains 13 rest on said respective first rails 14. A train of support rods 16 are provided between the opposite side endless chains 13. Said support rods 16 are coupled to each chain 13 via an arcuate coupling member 15. A carriage roller 17 is rotatably mounted on each support rod 16. Second rails 18 are provided on the inner side of the first rails 14 on the opposite lateral ends of the supports 10. They support the arcuate coupling members 15. Referring back to FIG. 7, a motor 19 provides drive torque, which is transmitted to the support shafts 11 via a drive chain 20 and sprockets 12.

Figure 11:
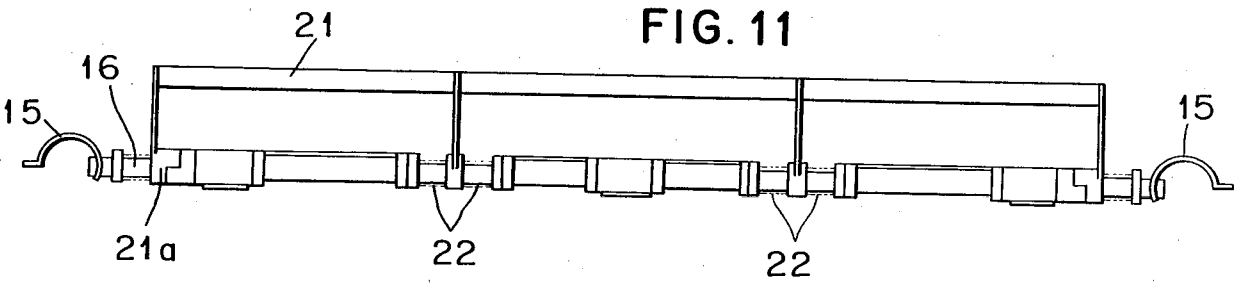
FIG. 11 is a front view showing a pusher member.
Figure 12:
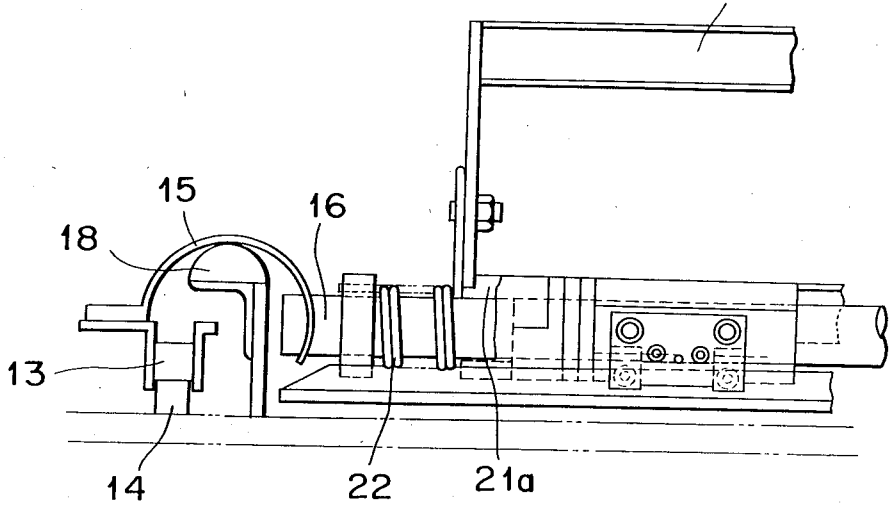
FIG. 12 is a view showing part of the same pusher member in detail.
Figure 13:
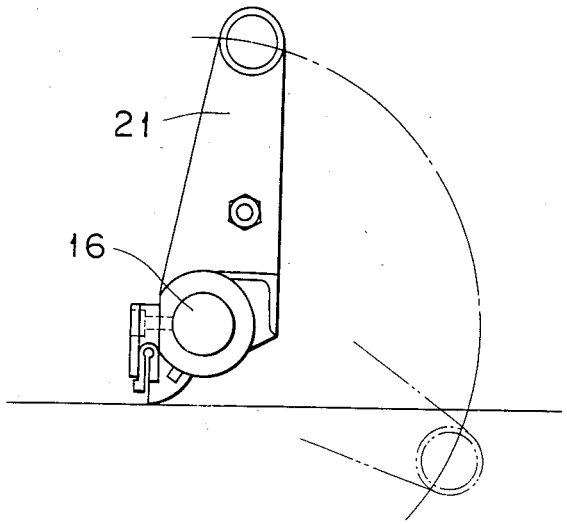
FIG. 13 is a side view of the same.

A pusher member 21 is provided on the support rod 16 on the leading one of the plurality of carriage rollers 17 as taken in the direction of transport. It can be erected and turned down with respect to the support rod 16 via support members 21*a* (FIGS. 11, 12, 13). It is normally held upright by a bias spring 22 provided on the support rod 16. It can be turned down against the spring force of the spring 22 in the direction of transport of the carriage rollers 17.

Figure 9:
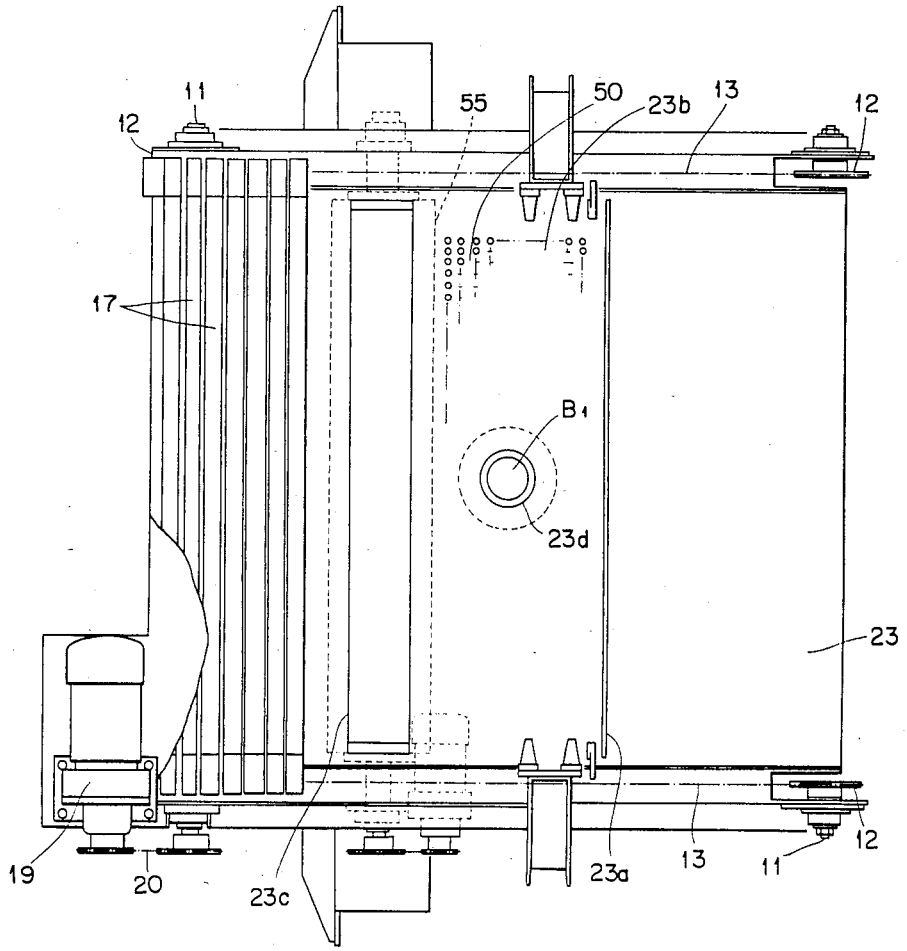
FIG. 9 is a plan view showing the same unpacking section.

Referring to FIG. 9, a bed 23 for supporting the material is provided on the supports 10 immediately beneath the surface of transport by the rollers 17. It has a slot section 23*a* extending in the transversal direction perpendicular to the direction of transport, a suction opening section 23*b* having a plurality of suction holes, a suction opening section 23*c* for positioning a suction drum and an opening section 23*d* for positioning the support member B1.

Figure 8:
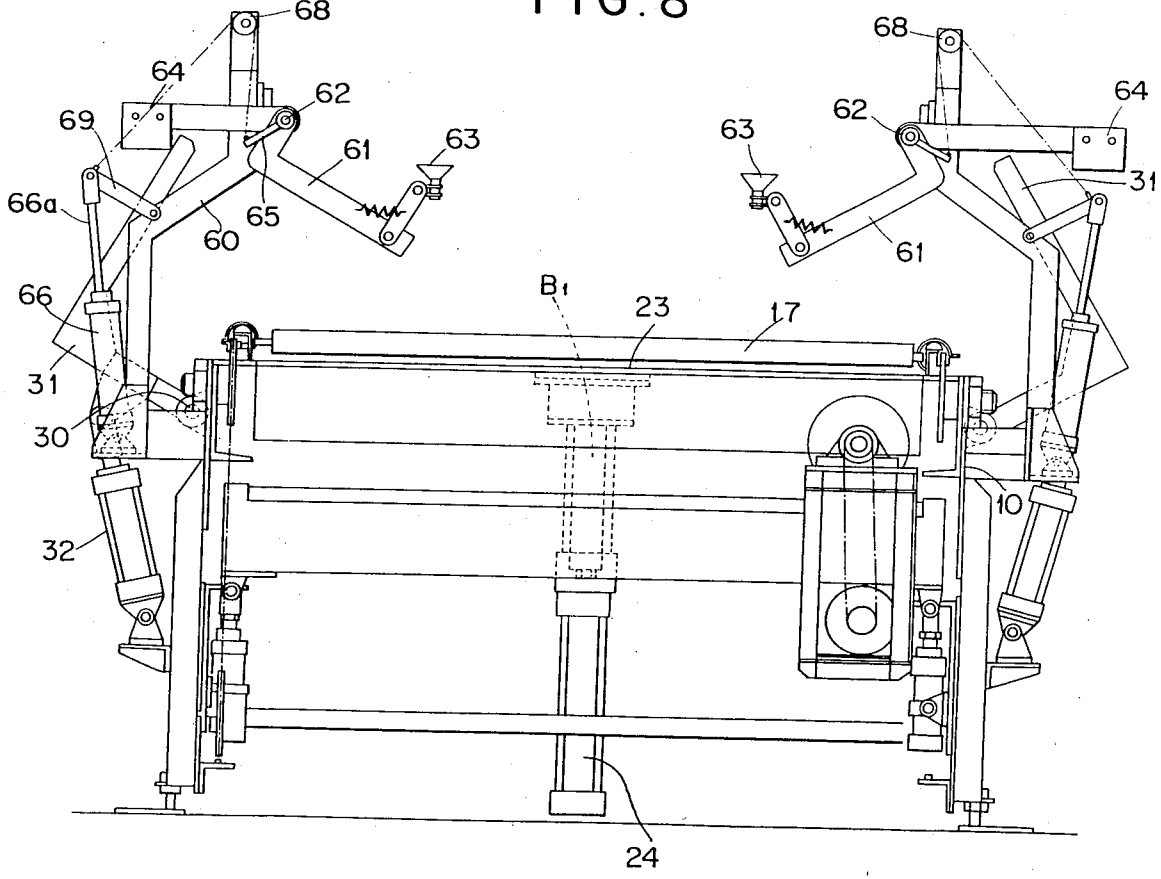
FIG. 8 is a front view showing the same unpacking section.

Referring to FIG. 8, on the opposite sides of the supports 10 in the transversal direction perpendicular to the direction of transport, positioning arms 31 are pivoted on shafts 30 such that they can be advanced and retreated by air cylinders 32 with respect to the top of the bed 23. Each positioning arm 31 has a side engaging member 31*a* for engaging the side of the compressed tobacco material box 1 supplied onto the supports 10 to make transversal adjustments and a rear end engaging member 31*b* for engaging the rear end of the box 1 to make longitudinal adjustments.

Figure 14:
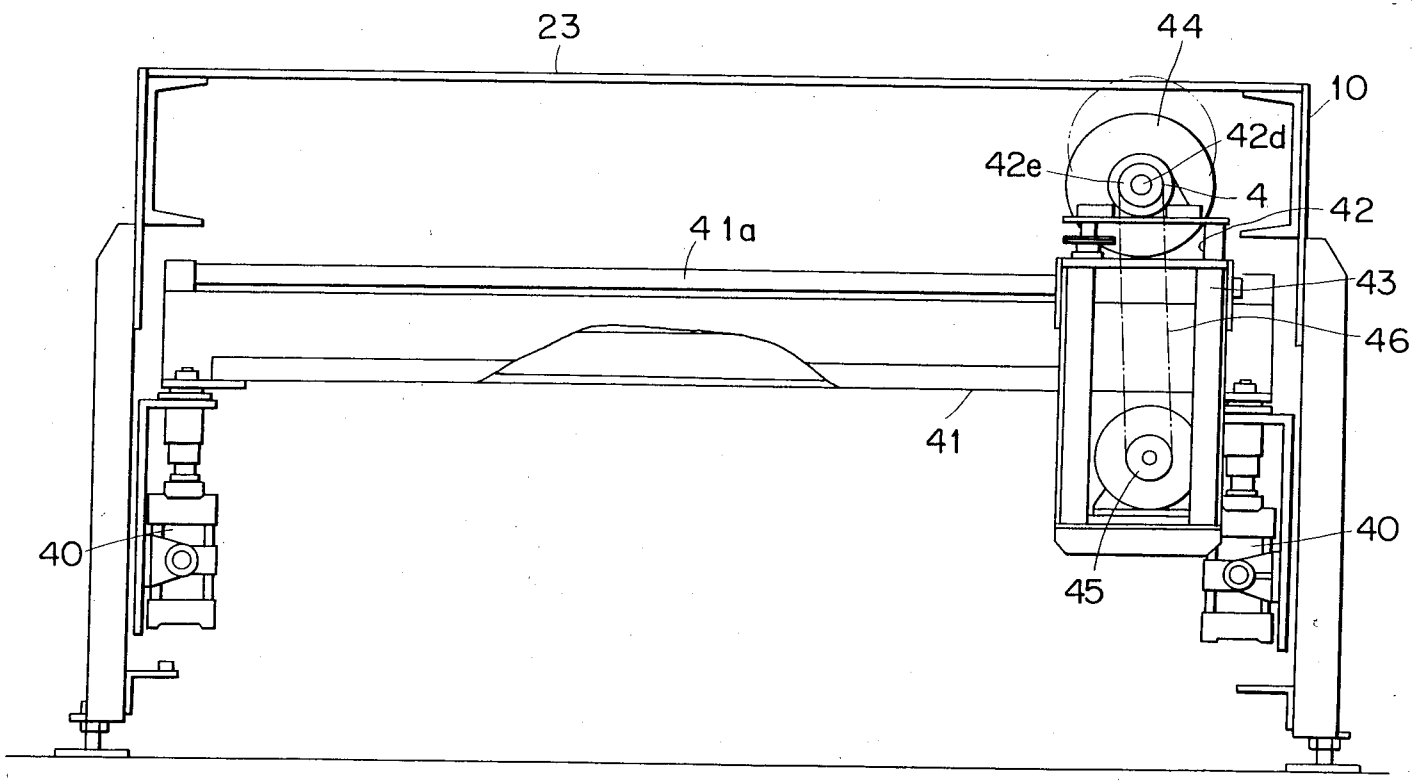
FIG. 14 is a front view showing a band cutter.

Referring to FIG. 14, a pair of air cylinders 40 are provided at the opposite lateral ends of the bed 23 on the supports 10 beneath the slot section 23*a*. A support member 41 can be vertically moved by the pair of air cylinders 40. It carries a knife holder 42 movable by a slide lever 41*a* in the direction of the slot section 23*a*. It also carries a shift member 43 for the knife holder 42. Said shift member 43 is moved sideways by pneumatic means.

Figure 15:
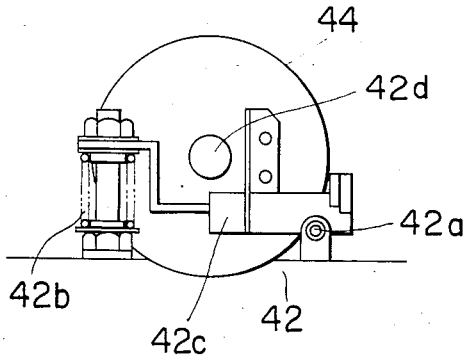
FIG. 15 shows a mechanism for supporting a disc-like knife in the same band cutter in detail.

Referring to FIG. 15, a shaft 42*a* is provided on the top of the knife holder 42. Said knife holder extends perpendicular to the slot section 23*a*. A disc-like rotary knife 44 is mounted on a shaft 42*d* such that it can be rotated with respect to a knife support member 42*c*, which has one end pivotally mounted on the shaft 42*a* and other end supported by the knife holder 42 via a spring 42*b*.

Figure 16:
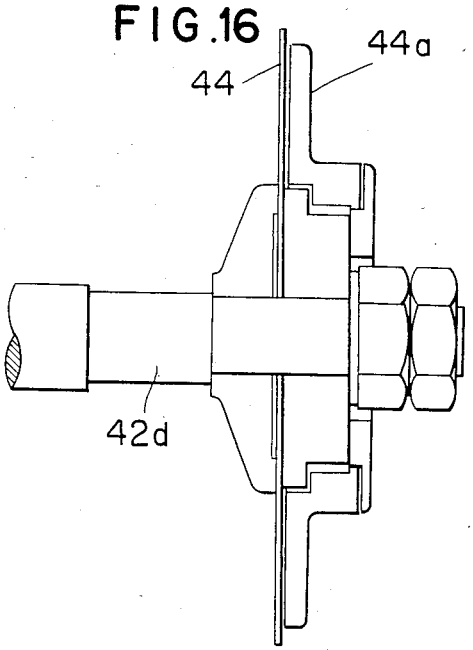
FIG. 16 is a front view showing the disc-like knife.

Referring to FIG. 16, a disc-like guide plate 44*a* is provided on one side of and coaxially with the disc-like knife 44. The shaft 42*d* has a pulley 42*e*, to which power is transmitted from a motor 45 provided on the shift member 43 via a belt 46.

Figure 6:
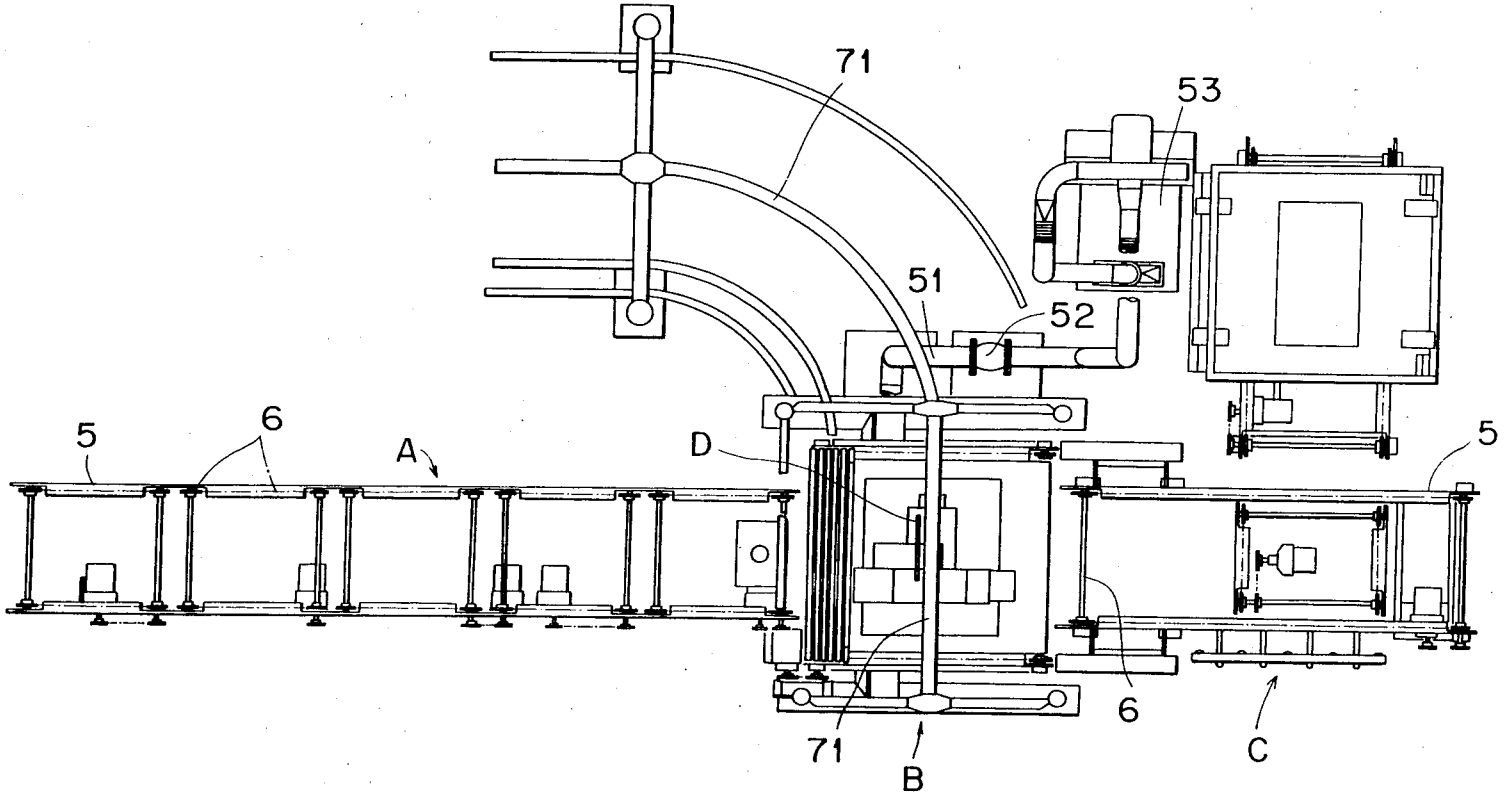
FIG. 6 is a plan view showing the same apparatus.
Figure 17:
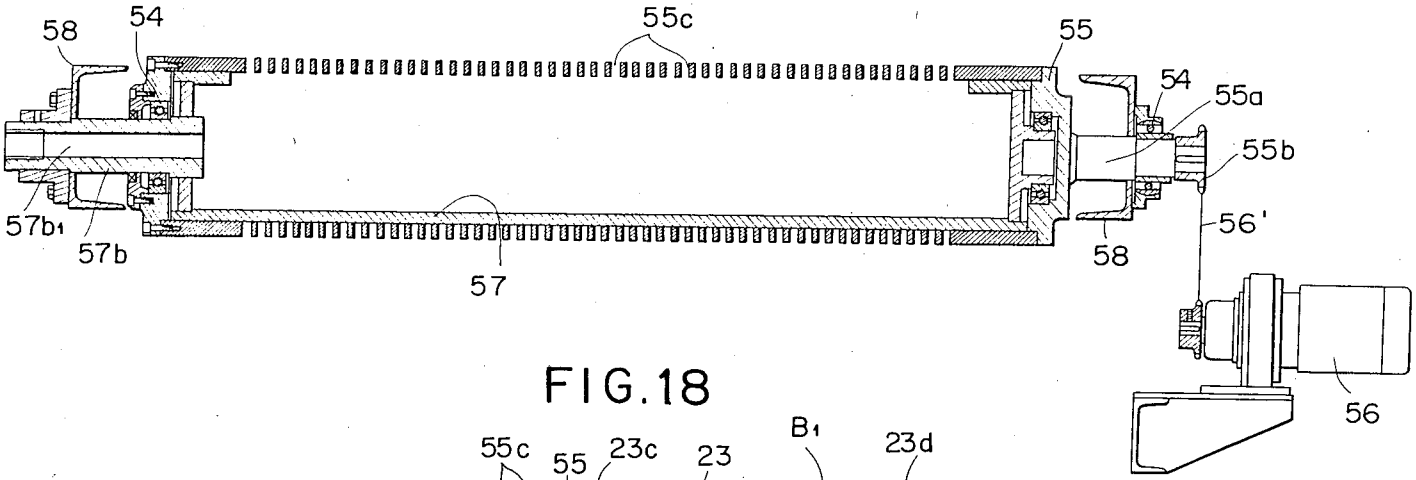
FIG. 17 is an axial sectional view showing a suction drum.
Figure 18:
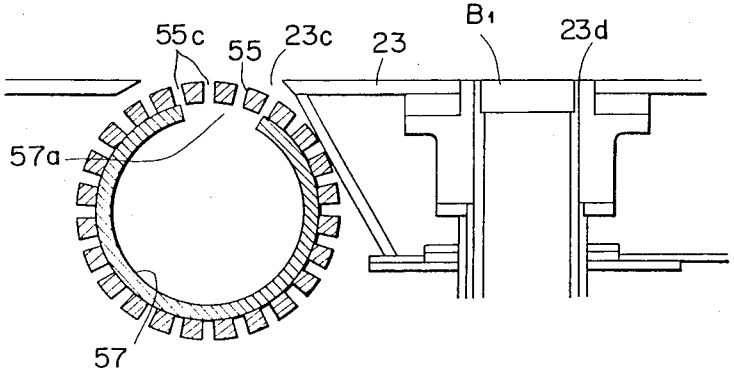
FIG. 18 is a sectional view showing a bed with the suction drum.

Referring to FIGS. 6 and 9, a suction blower 53 is provided such that said suction blower 53 is communicated with a plurality of suction openings in the suction opening section 23*b* of the bed 23 via a pipe 51 and a control valve 52. In the opening section 23*c* in the bed 23, a moisture-proof paper sheet suction drum 55 extending perpendicular to the direction of transport is rotatably supported in bearings 54 as shown in FIGS. 17 and 18. It is driven by a motor 56 via a sprocket 55*b* provided on its shaft 55*a* and a chain 56'. The periphery of the suction drum 55 has a number of suction holes 55*c*. An inner cylinder 57 is provided in the drum 55. Said inner cylinder 57 has an axial slot 57*a* corresponding to the opening section 23*c* and is secured at one end to a shaft 57*b* (FIG. 17). The shafts 57*b* are supported in bearings 58. The shaft 57*b* has a bore $57b_1$ communicating with the pipe 51.

On the opposite sides of the supports 10 as taken in the transversal direction perpendicular to the direction of transport, stems of arms 61 are rotatably mounted by pins 62 on support posts 60. The arms 61 have suction pads 63 provided at the free ends thereof. The pads can be advanced and retreated over the top of the bed 23. In addition to said arm 61, balance weights 64 and drive levers 65 are attached to said pins 62 at a predetermined angular relationship. Wires 67 are provided between said drive levers 65 and piston 66*a* of air cylinder 66 by way of pulley 68. Support rods 69 are provided between piston 66*a* and support posts 60.

Figure 19:
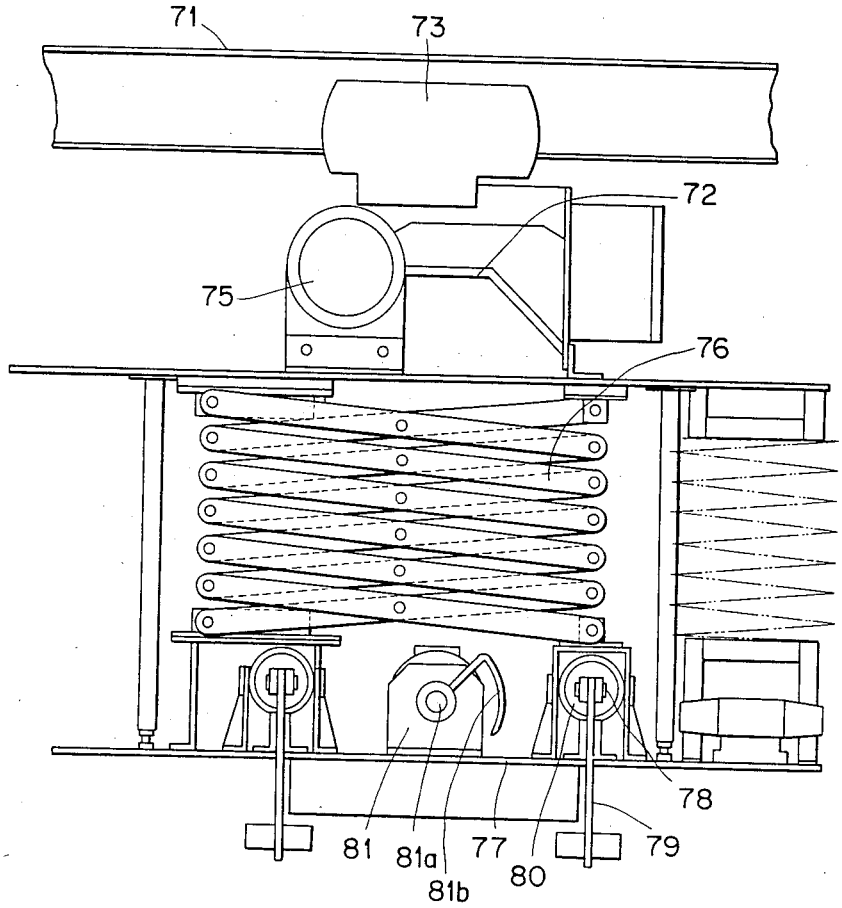
FIG. 19 is a side view showing a lifter.
Figure 20:
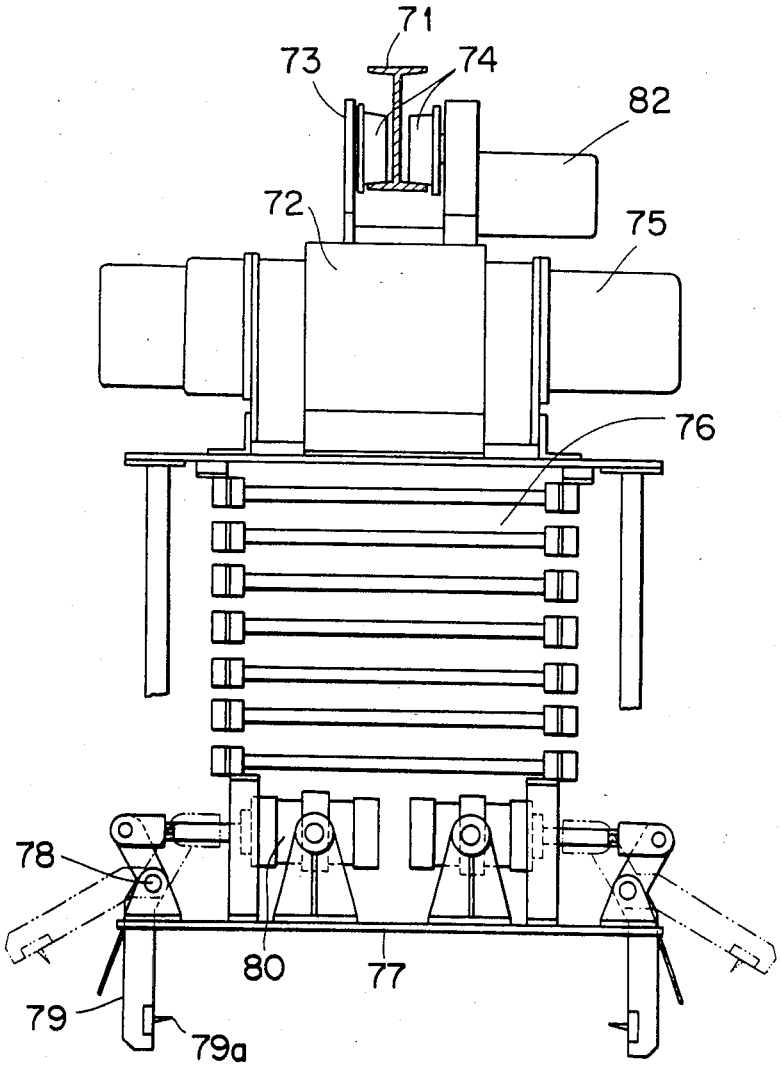
FIG. 20 is a front view showing the lifter.
Figure 21:
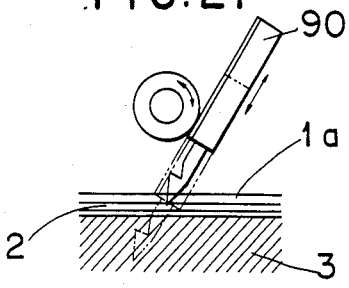
FIG. 21 is a view showing a harpoon for removing moisture proof paper.

Referring to FIGS. 6, 19, and 20, the lifter D slidably depends from a rail 71, which extends sidewise above the supports 10 in the unpacking section B. Said lifter D includes a support member 72 integral with upper wheel supports 73 facing each other. Wheels 74 rotatably supported by the wheel supports 73 engage the opposite sides of the rail 71. The wheels 74 are driven by a motor 82. A lift member 76 is mounted on the supports 73 via motordriven hoist 75. A holding plate 77 depends from the lift member 76. Holding arms 79 for holding the compressed tobacco material box 1 are pivotally mounted on a shaft 78 on the opposite sides of the holding plate 77 and driven by air cylinders 80. Each holding arm 79 has a pawl 79*a* projecting from the inner side of its free end. A motor 81 is secured to the central portion of the holding plate 77. Its shaft 81*a* can be pneumatically rotated up to a constant angle and has a pawl 81*b*. The pawl 81*b* is adapted to penetrate the box for supporting same. A pair of counter rotating pawls (not shown) are provided with harpoons 90 for removing moisture proof paper 2 as shown in FIG. 21.

In operation, the compressed tobacco material box 1 is placed on the feed-in conveyor A (FIG. 5) with the flaps 1*a* facing downward and with the turns of band extending perpendicular to the direction of transport. At the leading end of feed-in conveyor A, the top surface of the box packed with compressed tobacco is drilled by drill E to overcome the difficulty in lowering the compressed tobacco from the box lifted by lifter D (to be mentioned later) due to lack of air into the box 1 through the top flaps. Instead of providing the drill E, the box may be manually drilled beforehand. Since the train of carriage rollers 17 provides an area corresponding to the bed 23, said train of carriage rollers 17 taking position at a feed-in side of the bed 23 as shown in FIG. 7 proceed, when driven by motor 19, to cover the bed 23 at an upper run of the endless chains 13 while receiving the box 1 from the feed-in conveyor A. At this time, the unpacking section B is ready to unpack the compressed tobacco material box 1. More specifically, the carriage rollers 17 are positioned above the bed 23, and the positioning arms 31 are in the open state (FIG. 8). The disc-like knife 44 is held at a position below the supports 10 by the air cylinder 40 (FIG. 14).

Referring to FIGS. 5 and 7, the compressed tobacco material box 1 is transferred from the feed-in conveyor A onto the carriage rollers 17. Then, the positioning arms 31 are closed from the opposite sides by the air cylinders 32. The side engaging members 31*a* and rear end engaging members 31*b* restrict the position of the compressed tobacco material box 1 on the carriage rollers 17. The motor 19 is subsequently operated to drive the carriage rollers 17 in the direction opposite to the direction of transport of the feed-in conveyor A. The compressed tobacco material box 1 on the carriage rollers 17 is thus returned until it is brought into engagement with the rear end engaging members 31*b*. The carriage rollers 17 are further driven to be beneath the supports 10, thus placing the compressed tobacco material box 1 on the bed 23 before they are stopped. The compressed tobacco material box 1 is positioned on the bed 23 such that its center coincides with the support member B1.

Thereafter, the support member 41 is raised by the air cylinder 40, thus causing the disc-like rotary knife 44 to intrude into the slot section 23*a* of the bed 23 (FIG. 14). The disc-like rotary knife 44 has been driven by the motor 45 prior to the rise of the support member 41, and it is moved along the slot section 23*a* from one end to the other end by the knife holder shift member 43, whereby the band 4 wound around the compressed tobacco material box 1 placed on the bed 23 is cut. At this time, the disc-like rotary knife 44 is urged upwards about the shaft 42*a* by the spring 42*b* and is capable of vertical displacement by about 2 cm (FIG. 15). Thus, the band 4 can be reliably cut even if the compressed tobacco material box 1 is deformed. Further, the guide plate 44*a* provided on one side of the disc-like rotary knife 44 serves to prevent the knife 44 from intruding excessively deeply into the compressed tobacco material box 1 and cutting the inner moisture-proof paper 2.

After the band 4 is cut, the disc-like rotary knife 44 is moved to a position beneath the supports 10 by the air cylinder 40 (FIG. 14), and at the same time the positioning arms 31 are brought to the open state (FIG. 8).

Then, the lift member 76 of the lifter D, which has been in a stand-by state above the unpacking section B to position the support member 72, is extended on scissors principle to lower the holding plate 77 until it engages the top of the compressed tobacco material box 1. Subsequently, the holding arms 79, which have been in the open state, are closed by the air cylinders 80, whereby their pawls 79*a* are caused to wedge into the opposite sides of the compressed tobacco material box 1 (FIG. 20), and the pawl 81*b* mounted on the shaft 81*a* of the motor 8*a* is rotated to penetrate the box material to hold the box 1 and upper moisture-proof paper 2 in the box (FIG. 19).

Thereafter, the holding plate 77 is raised by the lift member 76 (FIG. 4*c*). With the rise of the holding plate 77 the flaps 1*a* of the box 1 are gradually opened by the weight of the compressed tobacco material 3 (FIGS. 4*b* and 4*c*).

Figure 23:
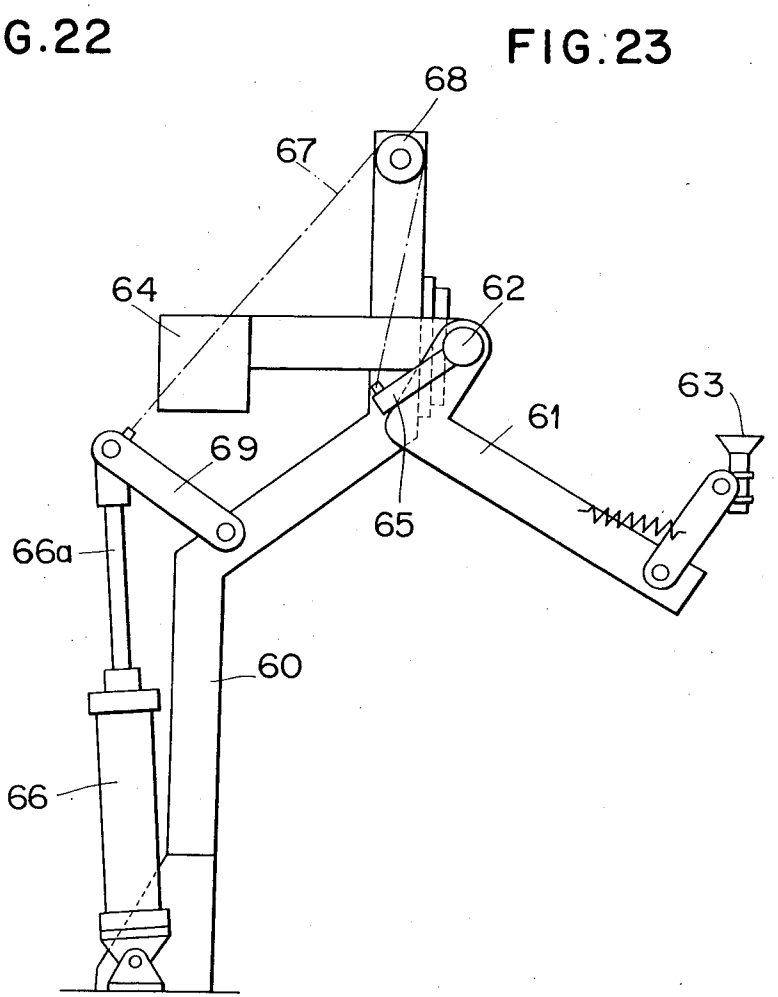
FIG. 23 is an explanatory view of the operation of the mechanism of FIG. 22.
Figure 22:
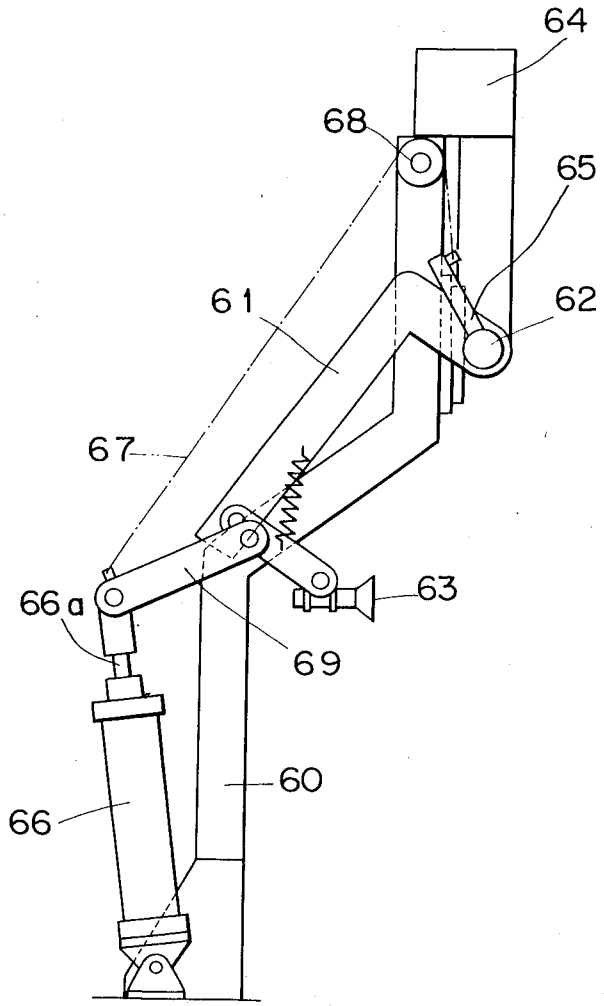
FIG. 22 is a front view of a mechanism for opening forcibly the flaps of the box.

In this stage, the air cylinders 64 are operated to cause the suction pads of the arms 61 to be stuck to the flaps 1*a*. The arms 61 are then operated in the opposite direction to forcibly open the flaps 1*a* (FIGS. 22 and 23).

When the compressed tobacco material box 1 is raised to a predetermined position, the support member B1 is raised by the air cylinder 24. After the support member B1 is raised through the opening defined by the flaps 1*a* until it engages the underside of the compressed tobacco material 3, the air supply to the air cylinder 24 is stopped, so that an electromagnetic valve (not shown) assumes a center position open to atmosphere (FIG. 4*c*).

As the compressed tobacco material box 1 is further raised, the back pressure in the air cylinder 24 is caused to escape gradually through the electromagnetic valve at the center position by the weight of the compressed tobacco material 3. The support member B1 is thus lowered gradually (FIG. 4*d*). The lower moisture-proof paper 2 and compressed tobacco material are thus eventually placed on the bed 23 (FIG. 4*e*).

Thereafter, the wheels 74 are driven by the motor 82 so that the lifter D is moved along the rail 71 sidewise of the unpacking section B (FIGS. 19 and 20). Then the empty box is taken out, and the lifter D is brought back to the stand-by position over the unpacking section B (FIG. 5).

When the descent of the support member B1 is completed so that the lower moisture-proof paper 2 and compressed tobacco material 3 are placed on the bed, an electromagnetic valve (not shown) is operated to withdraw air through the suction openings 50 in the suction opening section 23*b* and suction holes 55*c* in the suction drum 55. The lower moisture-proof paper 2 is thus secured to the bed 23.

Subsequently, the carriage rollers 17 are advanced by the motor 19, so that the compressed tobacco material 3 is fed out onto the feed-out conveyor C by the pusher member 21 on the leading carriage roller in the upright state. A brush may be provided on the underside of the pusher 21 such that it contacts the bed 23 to clean residual tobacco material thereon.

The suction through the suction openings 23*b* alone are subsequently stopped by the electromagnetic valve, and then the suction drum 55 is rotated by the motor 56, whereby the moisture-proof paper 2 is removed from the opening section 23*c* by the suction drum 55.

As has been described in the foregoing, according to the invention the boxed compressed material such as tobacco leaves can be readily taken out from the box without causing deformation of the material. At this time, the positioning of the material box on the unpacking section, cutting of bands, opening of the flaps and removal of the moisture-proof paper can be done automatically.

What is claimed is:

1. A method of unpacking a box packed with compressed material comprising the steps of placing a box packed with compressed material and having flaps at a bottom thereof on a bed having an opening therein;

lifting said box from said bed to allow said compressed material to start descending from within the box thereby causing said flaps to open gradually;

raising a support member from said opening through said opened flaps to support said compressed material from below;

continuing said lifting of the box until the flaps completely open; and lowering said support member to place said compressed material on said bed.

2. A method according to claim 1, further including a step of drilling said box at a top thereof prior to said lifting step.

3. A method according to claim 1, further including a step of forcibly opening said flaps during said lifting step.

4. An apparatus for unpacking a box packed with compressed material comprising an unpacking section having a bed with an opening therein, and a support member adapted to be raised and lowered through said opening;

feed-in conveyor means to feed a box packed with compressed material and having flaps at a bottom thereof to said unpacking section;

lift means provided above said unpacking section for lifting said box therefrom to allow said compressed material to start descending from within thereby causing said flaps to open gradually, said support member being raised to support said compressed material through said opened flaps and lowered when the flaps are completely opened to place said compressed material on said bed; and feed-out conveyor means to receive said emptied box from said unpacking section and feed out said emptied box from the apparatus.

5. An apparatus according to claim 4, wherein said unpacking section has carriage means for receiving the packed box from the feed-in conveyor means and removing the emptied box from the bed to the feed-out conveyor means.

6. An apparatus according to claim 5, wherein said carriage means includes a sprocket-and-chain mechanism having a pair of endless chains running on opposite lateral sides of the bed, a pair of rails to support said endless chains, a train of carriage rollers coupled to said endless chains and providing an area corresponding to said bed, said sprocket-and-chain mechanism being motor driven to proceed said train of carriage rollers from a feed-in side of the bed to cover the bed at an upper run of said endless chains and retract same toward the feed-in side thereof to expose said bed.

7. An apparatus according to claim 6, wherein said train of carriage rollers includes a leading carriage roller having a pusher member normally biased upright but adapted to turn down toward the feed-out conveyor means.

8. An apparatus according to claim 4, wherein said unpacking section has positioning means on opposite lateral sides of the bed to perform lateral and longitudinal alignments of the box.

9. An apparatus according to claim 4, wherein said bed has a laterally extending slot therein, said unpacking section having cutter means to project above said slot and travel sideways.

10. An apparatus according to claim 4, wherein said unpacking section has support posts provided on opposite lateral sides of the bed, an arm pivotally mounted on each support post, and a suction pad attached to said arm at an free end thereof.

11. An apparatus according to claim 4, wherein said bed has an opening, said unpacking section having sucking means below said opening.

* * * * *